United States Patent [19]

Wolf et al.

[11] Patent Number: 4,869,498

[45] Date of Patent: Sep. 26, 1989

[54] ISOKINETIC ERGOMETER

[75] Inventors: Rainer Wolf, Bad Durkheim; Juergen Volz, Friedelsheim; Rainer Denkinger, Nierstein; Volker Nolte, Bad Durkheim; Gerd Hussy, Hassloch, all of Fed. Rep. of Germany

[73] Assignee: KST-Motorenversuch GmbH & Co. KG, Bad Durkheim, Fed. Rep. of Germany

[21] Appl. No.: 156,936

[22] Filed: Feb. 17, 1988

[30] Foreign Application Priority Data

Feb. 17, 1987 [DE] Fed. Rep. of Germany ..... 3704918

[51] Int. Cl.[4] ..... A63B 21/00; A63B 69/06

[52] U.S. Cl. ..... 272/130; 272/72

[58] Field of Search ..... 272/72, 130, 93, 134, 272/129; 73/379

[56] References Cited

U.S. PATENT DOCUMENTS

| | | | |
|---|---|---|---|
| 3,266,801 | 8/1966 | Johnson | 272/72 |
| 3,369,403 | 2/1968 | Carlin et al. | 272/130 |
| 3,902,480 | 9/1975 | Wilson | 272/130 |
| 3,998,100 | 12/1976 | Pizatella et al. | 272/129 |
| 4,063,726 | 12/1977 | Wilson | 272/130 |
| 4,235,437 | 11/1980 | Ruis et al. | 272/130 |
| 4,258,913 | 3/1981 | Brentham | 272/67 |
| 4,482,152 | 11/1984 | Wolff | 272/130 |
| 4,726,583 | 2/1988 | Olsen et al. | 272/130 |

FOREIGN PATENT DOCUMENTS

| | | |
|---|---|---|
| 198746 | 10/1986 | European Pat. Off. . |
| 1902232 | 7/1970 | Fed. Rep. of Germany . |
| 3526144 | 1/1987 | Fed. Rep. of Germany . |

*Primary Examiner*—S. R. Crow

*Attorney, Agent, or Firm*—Foley & Lardner, Schwartz, Jeffery, Schwaab, Mack, Blumenthal & Evans

[57] ABSTRACT

The present invention provides an isokinetic ergometer comprising a movement guide, power gripping points, a brake unit connected therewith and a speed regulator, characterized by the following features:

(a) the power gripping points are mechanically connected with a piston movable in a cylinder, (b) a flow regulation valve is attached to the cylinder, and (c) the cylinder and flow regulation valve are hydraulically connected with one another via a pipe, the flow regulation valve regulating the length of the stroke.

9 Claims, 4 Drawing Sheets

ISOKINETIC ERGOMETER

BACKGROUND OF THE INVENTION

The present invention relates to an isokinetic ergometer. Erogmeters are used for training and precise muscle formation for sportsmen and sportswomen and also for gymnastic and therapeutic purposes. As a rule, they comprise a movement guide, for example, a seat sliding on a rail; power gripping points, for example, belts, oars, impact and traction devices with hand grips or other means of taking up power; and brake units or speed controls associated therewith. Levers and pistons connected with an appropriate mechanism thereby produce braking against a resistance which is overcome by arm and/or leg movement and/or by body movement. The return movement can take place substantially without exertion of strength.

Isokinetic or eccentric training cannot be carried out with previously known ergometers. In the case of isokinetic training, the course of movement takes place with constant speed, independently of the applied force. According to sports-medical knowledge, this type of training is, in many regards, the most effective. Therefore, there is a great need for exercise devices which make possible an isokinetic course of movement.

SUMMARY OF THE INVENTION

Therefore, it is an object of the present invention to provide an improved ergometer.

It is a particular object of the invention to provide an isokinetic ergometer which overcomes the disadvantages of prior devices and provides the possibility of both isokinetic and eccentric exercise.

In accomplishing the foregoing objects, there has been provided according to the present invention an isokinetic ergometer, comprising power gripping means for exerting power against a force; and a control unit connected with the power gripping means for controlling the amount of force; wherein the control unit comprises: a piston movable in a cylinder, a flow regulation valve attached to the cylinder, the cylinder and flow regulation valve being hydraulically connected with one another via a pipe, the flow regulation valve regulating according to the length of the stroke of the power gripping means, and wherein the power gripping means is mechanically connected with the control unit.

Further objects, features and advantages of the present invention will become apparent from the detailed description of preferred embodiments that follows, when considered together with the accompanying figures of drawing.

DETAILED DESCRIPTION OF PREFERRED EMBODIMENTS

Figure 1:
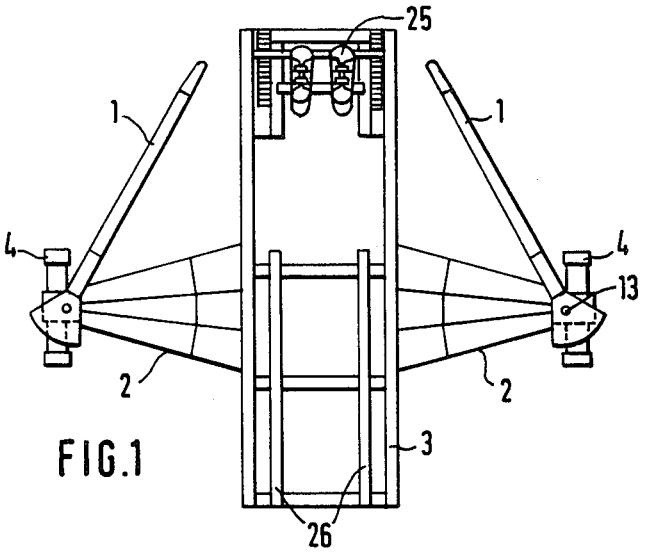
FIG. 1 illustrates the construction of a rowing ergometer.

According to the present invention, the ergometer comprises a movement guide, power gripping points, a brake unit connected therewith, and a speed regulator which is characterized by the following features:

(a) the power gripping points are mechanically connected with a piston movable in a cylinder, (b) a flow regulation valve is attached to the cylinder, (c) the cylinder and flow regulation valve are hydraulically connected with one another via a pipe, the flow regulation valve preferably regulating the length of the cylinder stroke.

A flow regulation valve is preferably a throttle valve having a differential pressure valve. The pressure gradient on the throttle is kept constant, and the flow of the hydraulic fluid is almost independent of the working pressure. Furthermore, for example, valves with electrical control circuits are also used as flow regulation valves.

A purely isokinetic training is possible with the above-described arrangement. The fluid moved by the piston can thereby be conveyed via a flow regulation valve into a container from which, in the case of the return of the piston, for example, by the return movement of an oar, it can be returned to the cylinder chamber.

Training with the help of the device according to the present invention can be considerably improved when the hydraulic fluid is conveyed into a pressure reservoir and the fluid, with a pressure decrease, is again introduced into the cylinder via a return valve, whereby the piston (and with it the power gripping points) is moved back at a speed determined by the pipe cross-section or is at least assisted in its movement. In the same way, however, the piston can also be connected with a return spring.

The rate of flow of the hydraulic fluid can be adjusted in an advantageous way to the particular requirements, i.e. to the training program, by an adjustable shutter arranged in the flow regulation valve.

All adjustment valves and, at particular parts of the device, dynamic procedures can be checked and converted according to data by measurement value indicators so that a continuous control or a comparison with existing values is possible without delay.

The device according to the present invention is constructed so as to be especially suited for use in the field of top performance sports.

The mechanical transmission of the training movement to the pistons takes place, according to the present invention, in an especially simple and dependable way, for example, with the help of a pin connected with the lever or a cable line reel to which is attached a cogwheel that cooperates with a toothed rack. The toothed rack is connected with the piston, and the training movement moves this correspondingly backwards and forwards.

Furthermore, according to the present invention, it is also possible to combine the isokinetic training with an eccentric training, whereby the type of training can be varied and the training output can be increased. Both types of training are attuned to an especially high degree, particularly to rowing training.

For this purpose, it is suggested to attach a hydraulic motor onto the pipe connected with the cylinder and to impinge the pistons with predetermined pressures and flow speeds.

With the use of the last-mentioned measures, a reversal of the training work takes place in that the person training must work against a force exerted via the power gripping points. In principle, this can take place in a simple way in both directions of movement, in that the front and rear side of the piston work together alternatingly with the hydraulic motor.

However, according to present knowledge, a force free return of the power gripping points or also a return of the power gripping points force-supported by the above-mentioned pressure reservoir or by a return spring is sufficient.

The eccentric training work brought about against the hydraulic motor can thereby take place especially isokinetically, for which purpose only the introduction of an appropriate flow regulation valve between the motor and the piston is necessary, which can optionally be ensured by its own return valve connected in series.

The change from purely isokinetic to eccentric training can be carried out by means of a slider which, on the one hand, connects the inlet of the piston with the flow regulation valve of the purely isokinetic circuit or alternatively to the pressure reservoir and to the return valve associated therewith or, in a second position, connects the piston inlet with the hydraulic motor or its circuit guide.

The hydraulic motor is thereby preferably connectable upstream with a storage container and downstream, via a slider, either with the cylinder of the ergometer or again with the storage container, via the pipe to the pressure reservoir and an inserted directional valve.

The hydraulic motor is preferably constructed as a constant feed pump in order to build up a constant potential in front of the flow control valve associated therewith. A pressure valve connected with the storage container is arranged between the flow regulation valve and the motor.

By "power gripping points" it is understood herein as points on which the training person acts upon the ergometer. These can be the hand grips of the cable line or lever, for example, in the case of a rowing ergometer, or a foot support in the case of a apparatus, or also the arm or foot holdings of a swimming apparatus or the like, as well as the projections of a back-stretching apparatus.

The possibility of combining isokinetic and eccentric courses of movement according to the present invention makes the subject matter of the present invention especially suitable for physiotherapeutic purposes in the course of rehabilitation.

Trials with the apparatus according to the present invention have produced a high degree of acceptance, as well as training motivation and have resulted in surprisingly high increases of performance. A preferred field of use is in rowing training.

The present invention will now be described in more detail with reference to several exemplary preferred embodiments in the form of a rowing ergometer, reference being made to the accompanying drawings.

In FIG. 1 is illustrated the construction of a rowing ergometer. On a frame 3 are fixed arms 2 in which sculls or oars 1 are tiltably mounted on axles which drive the pistons. The fixing of the oars 1 on the axles can thereby in principle also be made vertically tiltable in order to imitate the dipping in the lifting out of the water of the blades. The axle for the tilt-movement of the rower is formed by a pin 13 which, via a power transmission, acts mechanically, for example, via connecting rods, on a piston movable in a cylinder 4. On the head side is arranged a foot support 25 and on rails 26 a seat (not shown) slides. This arrangement is made to approximate the environment of a rowing boat.

Figure 2:
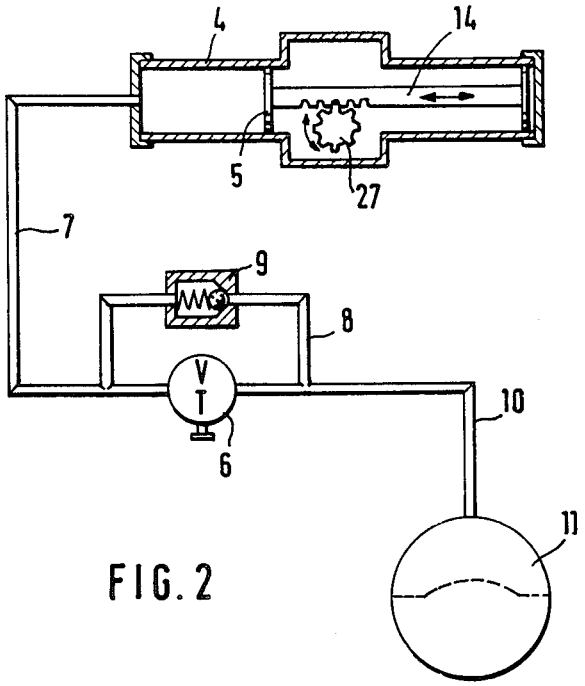
FIG. 2 schematically illustrates the hydraulic arrangement for isokinetic training.

FIG. 2 shows the above-mentioned cylinder 4 in which a piston 5 is movably housed. The piston 5 is connected with a toothed rack 14 which is driven via a cogwheel 27. The cogwheel 27 is mounted on pin 13 (FIG. 3) which is connected with the oar and, corresponding to the rowing movement, moves the rack 14 and piston 5 back and forth. On the cylinder is connected, via a pipe 7, a flow regulation valve 6 which supplies a pressure reservoir 11 via a pipe 10. The input takes place with a predetermined volume flow (v =constant) which, apart from the inversion point, remains the same independently of the pulling force exerted on the oar.

Thus, the amount of hydraulic fluid corresponding to the content of the cylinder 4 reaches the pressure reservoir 11 and is passed from this, via the return valve 9 in the by-pass 8, back to the cylinder 4.

Instead of the pressure reservoir 11, there can, in principle, be used any type of storage vessel; however, other types do not assist the return of the oar.

Figure 3:
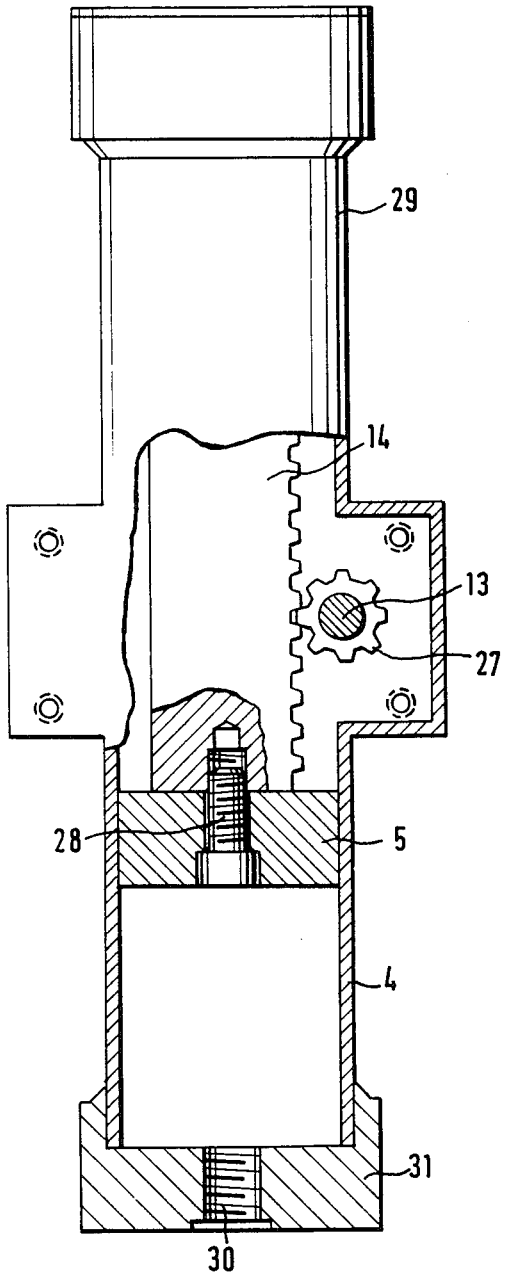
FIG. 3 is a plan view, partly in section, of a means for power transfer to the piston.

FIG. 3 shows, in enlarged illustration for a better understanding, the power transmission via the pin 13 and the cogwheel 27 to the toothed rack 14 which is connected rigidly via the screw 28 with the piston 5. In the backward continuation 29, the toothed rack 14 is countermounted in order not to allow the engagement of the cogwheel 27 to be lost.

Figure 5:
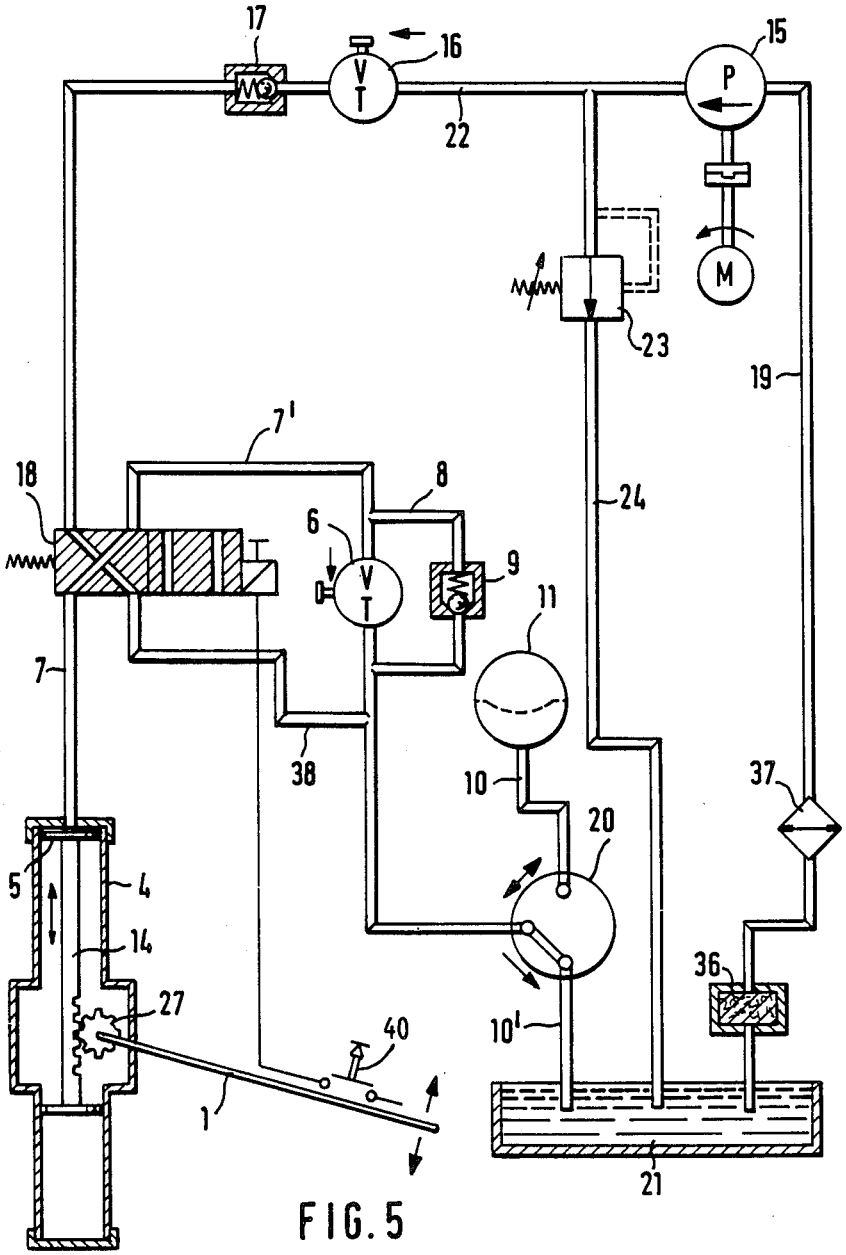
FIG. 5 schematically illustrates a combined system for isokinetic and eccentric training.

The cylinder 4 can be connected via the bore 30 in the head plate 31 to the hydraulic pipe system (FIG. 2 and FIG. 5).

Figure 4:
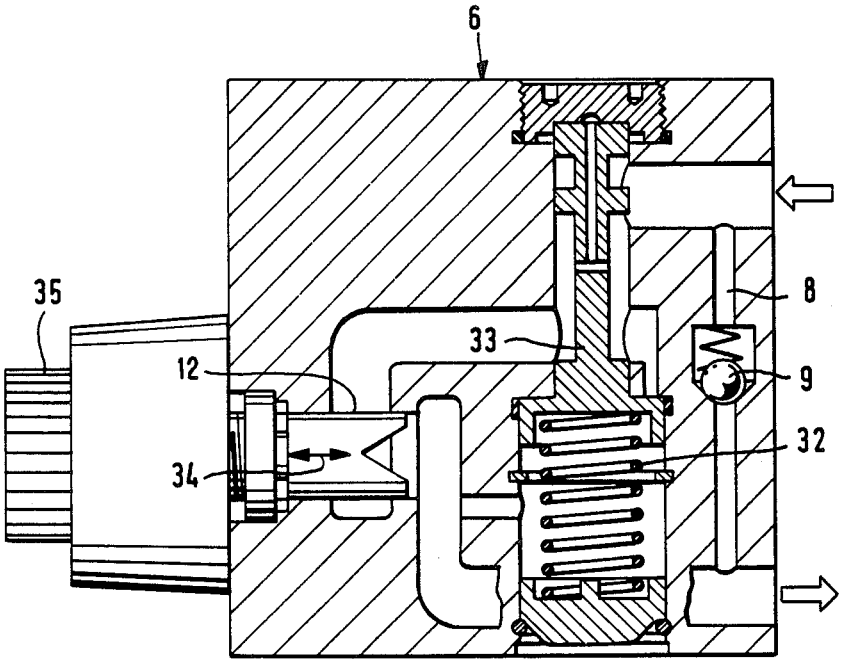
FIG. 4 illustrates a flow regulating valve in cross-section.

FIG. 4 shows a flow regulation valve with differential pressure spring 32 and valve piston 33 which can be used according to the present invention. The arrows indicate the direction of flow in the case of impingement of the flow regulation valve, the flow thereby being guided via the shutter 12 which, with the help of the hand wheel 35, fixed the throughput to predeterminable values by movement in the directions indicated by arrow 34. In this valve, the by-pass 8 is preferably integrated along with the return valve 9.

FIG. 5 shows the combination of the isokinetic hydraulics according to FIG. 2 with an eccentrically acting and connectable arrangement. This connectable, eccentric manner of working, in which the training person must work against a force applied externally, is achieved by the hydraulic motor 15. The motor acts via the pipe 22, when the valve 18 is appropriately positioned, on the piston 5. In order to be able to operate the hydraulic motor 15 with constant speed of rotation or constant pressure, it is connected via the branch 24 with a pressure valve 23.

The hydraulic motor 15 is supplied with hydraulic fluid from a storage container 21 via the pipe 19, a filter 36 and a cooler 37, and gives off excess hydraulic fluid, via the pressure valve 23, back into storage container 21.

In order to make possible isokinetic-eccentric training, there can be provided in the pipe 22 an additional flow regulation valve 16 which is protected by its non-return valve 17.

The lever (oar) 1 has a switch 40 which moves the cut-off valve 18 from the illustrated position to the left and frees the inflow from the hydraulic motor 15. In the opposite-lying position, the valve 18 is freed and moved back by a spring. The fluid passes via the pipes 7, 7' and 10' to the storage container 21 in the case of appropriate positioning of the directional valve 20 which closes off the pressure reservoir 11 for eccentric training.

In the case of purely isokinetic, non-eccentric operation, the valve 18 remains in the indicated position, whereby the circuit shown in FIG. 2, with flow regulation valve 6, by-pass 8 and return valve 9 or pressure reservoir 11, is used analogously. Only the directional valve 20 is to be turned for closure of the pipe 10.

Valve 18 can also have attached thereto a direct connecting pipe 38 through which hydraulic fluid can be circulated through the pipes 10, 10' and through the motor 15 without, for example, impinging the flow regulation valve 6 via the pipe 7'.

What is claimed is:

1. An isokinetic ergometer, comprising:

a seat;

a guide track along which the seat is slidable;

a support frame;

power gripping means for exerting power against a force; and a control unit connected with said power gripping means for controlling the amount of force, wherein said control unit comprises:

a piston movable in a cylinder, a flow regulation valve attached to the cylinder, said flow regulation valve including a housing having a fluid inlet and a fluid outlet, a resiliently urged valve piston acted upon by said fluid, adjustable shutter means for controlling fluid through the valve to predeterminable values and a bypass between the inlet and outlet including a return valve, The cylinder and flow regulation valve being hydraulically connected with one another via a pipe, the flow regulation valve regulating hydraulic resistance according to a power transmission through the power gripping means, and wherein the power gripping means is mechanically connected with said control unit and comprises oars of a rowing machine.

2. An ergometer according to claim 1, further comprising a toothed rack connected with the cylinder piston and a cogwheel engaged with the toothed rack, the power gripping means being connected with the cogwheel.

3. An ergometer according to claim 2, wherein the power gripping means comprises a lever tiltable mounted on a pin and cooperating via said cogwheel with said toothed rack firmly attached to the cylinder piston.

4. An isokinetic ergometer, comprising:

(a) power gripping means for exerting power against a force;

(b) a control unit connected with said power gripping means for controlling the amount of force, wherein said control unit comprises:

a piston movable in a cylinder;

a flow regulation valve attached to the cylinder, said flow regulation valve including a housing having a fluid inlet and a fluid outlet, a resiliently urged valve piston acted upon by said fluid, adjustable shutter means for controlling fluid through the valve to predeterminable values and a bypass between the inlet and outlet including a return valve; the cylinder and flow regulation valve being hydraulically connected with one another via a pipe, the flow regulation valve regulating hydraulic pressure according to a power transmission through the power gripping means and (c) a toothed rack connected with the piston and a cogwheel engaged with the toothed rack, the power gripping means being connected with the cogwheel said power gripping means comprising a lever tiltable mounted on a pin and cooperating via said cogwheel with said toothed rack firmly attached to the piston.

5. An ergometer according to claim 4, further comprising a hydraulic motor attached to the pipe connected with the cylinder.

6. An ergometer according to claim 5, further comprising, between the cylinder and the hydraulic motor, a second flow regulation valve connected in series with a second return valve.

7. An ergometer according to claim 5, further comprising means for switching on the hydraulic motor, comprising a cut-off valve actuatable to cut-off fluid pressure to the cylinder.

8. An ergometer according to claim 5, further comprising a second pipe connectable with the hydraulic motor via the flow regulation valve, a storage container for hydraulic fluid, and a directional valve arranged to selectively connect said second pipe with said storage container.

9. An ergometer according to claim 8, wherein the hydraulic motor comprises a constant feed pump, and the connecting pipe between the flow regulating valve and the pump includes a pressure valve in a branch which, on an outlet side thereof, is connected with the storage container.

* * * * *